US009243464B2

(12) United States Patent
Peter et al.

(10) Patent No.: US 9,243,464 B2
(45) Date of Patent: Jan. 26, 2016

(54) FLOW CONTROL DEVICE AND METHODS FOR USING SAME

(75) Inventors: Andreas Peter, Niedersachsen (DE); Carsten Freyer, Lower Saxony (DE); Thomas Kruspe, Niedersachsen (DE); Hans-Jurgen Faber, Neustadt (DE); Marcus Oesterberg, Kingwood, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 791 days.

(21) Appl. No.: 13/370,061

(22) Filed: Feb. 9, 2012

(65) Prior Publication Data

US 2012/0205122 A1 Aug. 16, 2012

Related U.S. Application Data

(60) Provisional application No. 61/441,414, filed on Feb. 10, 2011.

(51) Int. Cl.
*E21B 21/10* (2006.01)
*E21B 34/08* (2006.01)

(52) U.S. Cl.
CPC ..... *E21B 21/10* (2013.01); *E21B 34/085* (2013.01); *Y10T 137/0318* (2015.04); *Y10T 137/785* (2015.04); *Y10T 137/7922* (2015.04)

(58) Field of Classification Search
CPC ..... E21B 21/10
USPC ..... 166/319, 321, 373, 386
See application file for complete search history.

(56) References Cited

U.S. PATENT DOCUMENTS

| | | | | |
|---|---|---|---|---|
| 3,964,556 | A † | 6/1976 | Gearhart et al. | |
| 4,133,516 | A * | 1/1979 | Jurgens | 267/125 |
| 4,205,753 | A | 6/1980 | Raeber | |
| 4,766,924 | A | 8/1988 | Lee, III et al. | |
| 4,957,167 | A * | 9/1990 | Schultz | 166/319 |
| 5,007,454 | A | 4/1991 | Lee, II | |
| 5,924,490 | A | 7/1999 | Stone | |
| 6,401,823 | B1 † | 6/2002 | Gonzalez | |
| 6,728,444 | B2 | 4/2004 | Brennan, III et al. | |
| 6,854,532 | B2 | 2/2005 | Fincher et al. | |
| 7,093,662 | B2 † | 8/2006 | deBoer | |
| 7,201,184 | B2 | 4/2007 | Morrow et al. | |

(Continued)

OTHER PUBLICATIONS

PCT/US2012/024685; International Search Report and Written Opinion dated Feb. 10, 2012.

*Primary Examiner* — Giovanna C Wright
*Assistant Examiner* — Kristyn Hall
(74) *Attorney, Agent, or Firm* — Mossman, Kumar & Tyler, PC

(57) ABSTRACT

A fluid flow control apparatus includes a biasing member applying a biasing force to a closure member, and a sealing member receiving the closure member. A dampener operatively connected to the closure member resists a force applied to the closure member. A fluid seal is formed when the biasing member presses the closure member against the sealing member. The closure member and sealing member may cooperate to control fluid flow along a fluid conduit formed in a wellbore tubular. The apparatus may include an actuator that controls the force applied to the closure member. The actuator may adjust the biasing force, and/or the dampening force. Also, a controller control the actuator may be responsive to a signal generated at a surface location, a downhole location, and/or a signal generated by a sensor.

19 Claims, 4 Drawing Sheets

(56) References Cited

U.S. PATENT DOCUMENTS

| | | | |
|---|---|---|---|
| 7,255,323 | B1 | 8/2007 | Kadhim |
| 7,500,526 | B2 † | 3/2009 | Telfer |
| 7,584,801 | B2 † | 9/2009 | deBoer |
| 8,016,026 | B2 † | 9/2011 | Joseph |
| 8,066,079 | B2 | 11/2011 | De Boer |
| 2004/0124008 | A1 | 7/2004 | Fincher et al. |
| 2008/0029306 | A1 * | 2/2008 | Krueger et al. ..... 175/210 |
| 2009/0025928 | A1 * | 1/2009 | Lee ..... 166/178 |
| 2009/0145603 | A1 * | 6/2009 | Coronado ..... 166/255.1 |
| 2010/0044054 | A1 | 2/2010 | De Boer |
| 2011/0036591 | A1 | 2/2011 | George et al. |
| 2011/0168410 | A1 | 7/2011 | De Boer |

* cited by examiner
† cited by third party

FLOW CONTROL DEVICE AND METHODS FOR USING SAME

CROSS REFERENCE TO RELATED APPLICATIONS

This application claims priority from U.S. Provisional Patent Application Ser. No. 61/441,414, filed Feb. 10, 2011 the disclosure of which is incorporated herein by reference in its entirety.

BACKGROUND OF THE DISCLOSURE

1. Field of the Disclosure

This disclosure relates generally to flow control devices.

2. Background of the Art

Fluid pathways and conduits employ a variety of devices in order to control fluid flow. One illustrative device is a valve that is used to block fluid flow across a fluid path way upon occurrence of a specified condition. These valves may sometimes be referred to as flow stop valves. In some configurations, a flow stop valve may be set to remain open to allow fluid flow during normal operation, but close when operation is interrupted. Such interruptions of fluid flow may cause transient conditions, e.g., pressure waves, which may damage the flow stop valve or may hinder the closing of the flow stop valve. The present disclosure addresses these and other needs to minimize the undesirable effects of such transient conditions and other drawbacks of the prior art.

SUMMARY OF THE DISCLOSURE

In aspects, the present disclosure provides an apparatus for controlling flow of a fluid. The apparatus may include a closure member, a biasing member applying a biasing force to the closure member, and a sealing member receiving the closure member. A dampener may be operatively connected to the closure member and may resist a force applied to the closure member. A fluid seal may be formed when the biasing member presses the closure member against the sealing member. The apparatus may include a wellbore tubular in which the fluid conduit is formed and the closure member and sealing member may cooperate to control fluid flow along the fluid conduit. The apparatus may include an actuator configured to control the force applied to the closure member. The actuator may adjust the biasing force, and/or the dampening force. Also, a controller may control the actuator and may be responsive to a signal generated at a surface location, a signal generated at a downhole location, and/or a signal generated by a sensor.

In aspects, the present disclosure provides a method for controlling flow of a fluid. The method may include positioning a sealing member and a closure member along a flow path of the flowing fluid; applying a force on the sealing member using a biasing member; and resisting a force applied to the closure member using a dampener.

Examples of certain features of the disclosure have been summarized rather broadly in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION OF THE DISCLOSURE

In aspects, the present disclosure provides a flow control device for use in oil and gas well construction, completion, and production applications. One illustrative use of the flow control device is to stop the flow of a fluid, e.g., a drilling fluid, when a fluid mover (e.g., surface pumps) is stopped or deactivated. This may be a desirable function in dual gradient drilling (DGD) applications because such a flow control device can minimize a "u-tube" effect caused by equalizing the mud pressure between the inside of the drilling tubular and the return line. It may also be useful for keeping the drilling tubular filled with drilling fluid during connections in applications known as dynamic kill drilling (DKD) or riserless mud recovery (RMR). Illustrative embodiments of the present disclosure may minimize the dynamic pressure loss across the flow control device during normal operation, while ensuring a high crack open pressure from static flow state. Also, the closing motion may be dampened in order to prevent chattering from disturbing the closure of the flow control device. In certain embodiments, the dampening system may be adjusted to vary the time required to fully close or open the flow control device.

Figure 1A:
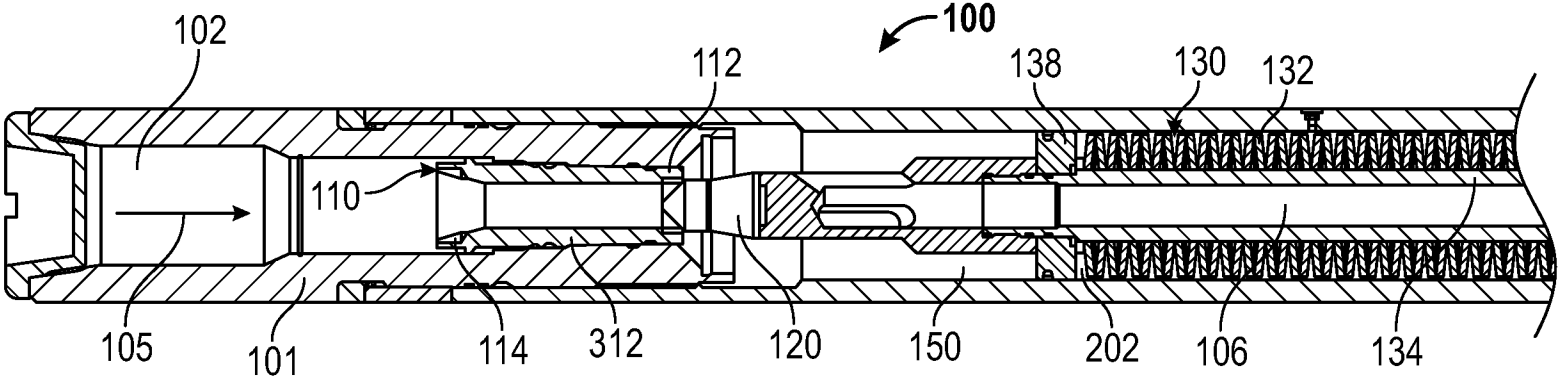
FIGS. 1A-B sectionally illustrate a flow control device made in accordance with one embodiment of the present disclosure.
Figure 1B:
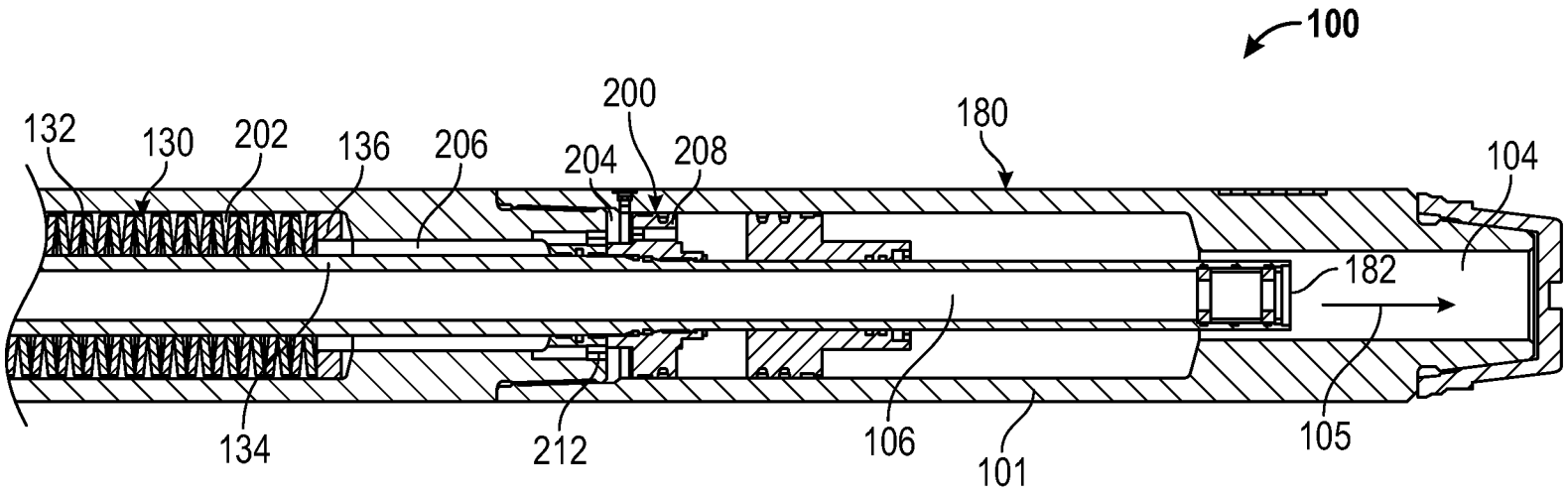

Referring to FIG. 1A-B, there is shown one embodiment of a flow control device 100 for controlling fluid flow along a conduit having an upper section 102 (FIG. 1A) and a lower section 104 (FIG. 1B). The flow control device may include an enclosure 101 that connects with the upper section 102 (FIG. 1A) and the lower section 104 (FIG. 1B); e.g., a threaded connection. In one arrangement, a fluid 105, which may be a liquid or a gas, flows from the upper section 102 to the lower section 104. The flow control device 100 may be configured to block this fluid flow upon the occurrence of one or more conditions. As used herein, the term "flow control device" may be a valve, choke, flow restrictor or other such device that can partially or completely block fluid flow along a path way. As used herein, the term fluid refers to liquids, gases, and mixtures thereof.

The flow control device 100 may include a flow path 106 providing fluid communication between the upper section 102 and the lower section 104, a sealing member 110, a closure member 120, and a biasing member 130. The sealing member 110 may be formed as a sleeve or ring-like member that has a seat 112. The closure member 120 may be a cone or other body complementary to sealing member 110 such that engagement with the seat 112 forms a fluid-tight seal between the upper and lowers sections, 102 and 104. This seal may be a metal-to-metal seal. The biasing member 130 is configured to bias the closure member 120 toward and against the sealing member 110. In one embodiment, the biasing member 130 may include spring members 132 (e.g., disk springs) supported on a mandrel 134. The springs members 132 may be disposed between a retaining wall 136 and a piston 138 that is connected to the mandrel 134. The closure member 120 may be disposed on the mandrel 134. These elements and features, as well as the other elements and features discussed below, may be partially or completely positioned in the enclosure 101.

In one arrangement, the biasing member 130 uses the spring force of the spring members 132 to translate the closure member 120 to the sealing member 110. The biasing force generated by the biasing member 130 may be adjusted to allow the sealing member 110 and the closure member 120 to engage or disengage in response to a predetermined flow condition. For example, the closure member 120 may unseat from the sealing member 110 when the pressure differential across the flow control device 100 exceeds a predetermined value. Similarly, the closure member 120 may seat against the sealing member 110 when the pressure differential across the flow control device 100 drops below a predetermined value. The opening and closing pressure differentials may be different values. It will be appreciated that the pressure differentials may be related to a surface controlled value such as fluid flow rate.

In one embodiment, the flow control device 100 may include a dampener 200 that is operatively connected to and controls the movement of the closure member 120 during seating with or unseating from the sealing member 110. In one arrangement, the dampener 200 may include a fluid that flows between two chambers 202, 204 via a channel 206. The fluid body may include a dampening fluid such as hydraulic oil or other similar liquid. The dampener 200 may be configured to have a specified resistance to fluid flow into and/or out of each of the chambers 202, 204. This resistance to flow may be used to dampen movement of the closure member 120.

For instance, the first chamber 202 may include an annular space in which the piston 138 translates. Thus, movement of the piston 138 varies the volume of the chamber 202. The second chamber 204 may include an annular space surrounding the mandrel 134 that is enclosed by a damping piston 208. The damping piston 208 is connected to the mandrel 134. Thus, movement of the piston 208 varies the volume of the chamber 204. The channel 206 may be configured to control a flow parameter of the fluid flowing between the chambers 202 and 204. In some embodiments, the channel 206 may include flow control elements 212 that control the rate at which fluid flows between the chambers 202 and 204. For example, the flow control elements 212 may be orifice plates, apertures, tortuous paths, nozzles, or valve elements. These elements 212 may vary parameters such as cross-sectional flow area (e.g., diametrical size of openings), distance fluid travels, etc. to impose a desired resistance to fluid flow. The resistance to flow may be direction insensitive or may vary depending on which direction the fluid is flowing across the channel 206 (e.g., into or out of the chamber 204).

In one mode of operation, the flow parameter (e.g., flow rate, pressure, etc.) of the fluid supplied to the upper section 102 reaches a value sufficient to generate a pressure against the closure member 120 that overcomes the biasing force of the biasing member 130. This may sometimes be referred to as the "crack open" pressure of the flow control device 100. Thus, the closure member 120 unseats and the fluid fills a cavity 150 next to the piston 138. The fluid pressure in the cavity 150 displaces the piston 138 and compresses the spring members 132. The movement of the piston 138 also reduces the volume of the chamber 202, which causes the dampening fluid to flow from the chamber 202 to the chamber 204 via the channel 206. During the transient conditions associated with the start of fluid movement, the spring force of the spring members 132 and the flow resistance in the channel 206 combine to resist the unseating movement of the closure member 120. That is, the damping force increases the "crack open" pressure of the flow control device.

The fluid pressure in the upper section 102 maintains the closure member 120 in an unseated position as long as a minimum pressure differential exists across the flow control device 100. When the valve 100 is in this open position, fluid flows from the upper section 102 across the flow passage 106 to the lower section 104.

At some point, the fluid flowing to the upper section 102 encounters a change in a flow parameter that causes the pressure against the closure member 120 to drop below the value sufficient to overcome the biasing force of the biasing member 130. For example, the pump pumping the fluid through the upper section 102 may be deactivated. The cessation of active pumping causes the flow rate and pressure in the upper section 102 to drop. Thus, the pressure differential across the flow control device 100 also drops. The lower pressure allows the spring force of the spring members 132 to shift or move the closure member 120 toward the seating member 110 by displacing the piston 138. The piston 138, the mandrel 134, and the dampening piston 208 are fixed to one another and move together. The movement of the piston 208 reduces the volume of the chamber 204, which causes the dampening fluid to flow from the chamber 204 to the chamber 202 via the channel 206. During closing, the flow resistance in the channel 206 resists the seating movement of the closure member 120. That is, the damping force modulates or lowers the speed at which the closure member 120 moves towards the seating member 110. By slowing the closing movement and allowing fluid to bleed through the flow control device 100 for a controlled duration, the damping force reduces or minimizes the risk of a rapid pressure build-up in the upper section 102 that may lead to hydraulic shock or water hammer.

Once the closure member 120 seats against the sealing member 110, the fluid in the upper section 102 may encounter a hydraulic shock (e.g., water hammer). That is, the sudden blockage in the upper section 102 may cause a pressure spike or pulse that momentarily increases the fluid pressure applied to the closure member 120. However, this pressure pulse must overcome the biasing force of the biasing member 130 and dampening force applied by the dampener 200 to unseat the closure member 120. If unseating occurs, the dampening force applied by the dampener 200 slows the opening movement of the closure member 120 in a manner previously described.

It should be therefore appreciated that the dampener 200 applies a dampening force that controls the movement of the closure member 120. In many instances, the movement of the closure member 120 during opening and closing is modulated or slowed in order to reduce the undesirable effects of rapid transients in pressure. For example, the speed at which the closure member 120 closes is reduced to minimize the impact between the closure member 120 and the sealing member 112 and to minimize the effect of hydraulic shock (e.g., chatter). The dampening force also increases the "crack open" pressure to resist chatter.

In certain embodiments, the flow control device 100 may include features to enhance operational performance. For example, in certain embodiments, a pressure differential generator 180 may be used to exert an opening force on the closure member 120 while fluid is circulated from the upper section 102 to the lower section 104. This opening force counteracts the biasing force of the biasing device 130. In one embodiment, the pressure differential generator 180 may include a flow restrictor such as a nozzle 182 positioned along the flow path 106 of the mandrel 134. In a static state when no fluid is circulating, the pressure differential generator 180 is not active. Thus, the biasing device 130 applies an unmodified force to the closure member 120 that results in a relatively high "crack open" pressure. Once fluid circulation has been established in flow path 106, the nozzle 182 generates a pressure differential that is applied to a piston, e.g., piston 138 (FIG. 1A), attached to the closure member 120. This pressure differential may be sufficient to maintain the closure member 120 in the open position. The use of the pressure differential generator 180 may reduce the dynamic pressure loss across the flow control device 100 during fluid circulation.

The FIGS. 1A-B embodiment may be described as a mechanical system that is calibrated to provide predictable behavior to known conditions. The calibration or tuning may be performed prior to operation and is not thereafter changed. Thus, the operating behavior of the FIGS. 1A-B embodiment may be considered static. Other embodiments may utilize systems or devices in order to adjust or control the behavior of the flow control device.

Figure 2:
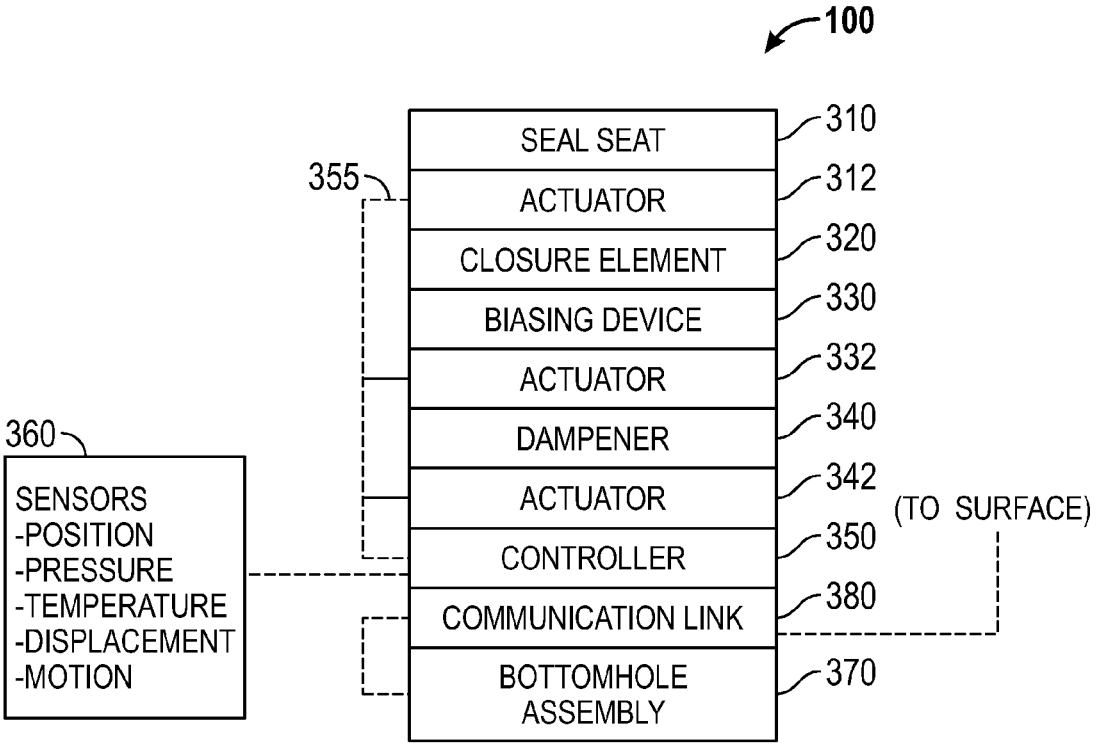
FIG. 2 illustrates in functional block diagram of a controllable flow control device made in accordance with one embodiment of the present disclosure.

Referring now to FIG. 2, there is shown in functional format another embodiment of a flow control device 100 that may be used to selectively block flow along a fluid conduit. The flow control device 100 may include a seat 310 and a closure member 320 that engage to block flow across a fluid conduit. The closure member 320 may be moved by a biasing device 330. The biasing device 330 may be energized by compressible gas, solid resilient members such springs as previously discussed, magnetic elements, or any other mechanisms suitable for generating a biasing force that urges the closure element 320 into sealing engagement with the seat 310.

In a manner previously discussed, the dampener 340 directly or indirectly controls the motion of the closure member 320. The dampener 340 may be arranged to oppose the biasing force of the biasing device 330 and/or the pressure applied by fluid to the closure member 320. As shown in FIGS. 1A-B, flow resistance applied to a fluid body circulated between two chambers may be one mechanism to generate a dampening force. In other embodiments, electromagnetic elements, friction brakes or eddy current brakes may be used to generate a dampening force. In still other embodiments, a material responsive to an electromagnetic field may be used. For example, magnetorheological fluids and electrorheological fluids may be formulated to exhibit a change in viscosity when subjected to an electromagnetic (EM) signal (e.g., a magnetic field or electrical current). In one arrangement, a spring arrangement such as in FIG. 1 may be immersed in an EM signal responsive fluid. An applied signal may increase or decrease the fluid viscosity to effectively change the dampening force of the dampener arrangement. In still other embodiments, a solid material such as a piezoelectric element or other similar EM signal responsive solid material may be used to selectively engage and apply frictional dampening force to the mandrel 134 of FIGS. 1A-B.

The seat 310, the closure member 320, the biasing device 330, and/or the dampener 340 may use one or more actuators to control the force applied to the closure member 320. As described above, this applied force may be a sum or a remainder of the biasing force and dampening force. It should be appreciated that this force may be arranged as controllable devices that can be adjusted, shifted, or oriented as needed.

For example, the seat 310 may be mounted on a movable sleeve (not shown) that shifts the axial position of the seat 310 vis-à-vis the closure member 320. For example, the embodiment of FIGS. 1A-B may be modified to include an actuator 312 that shifts a seat support 114 axially. The actuator 312 may be a pressure activated piston-cylinder arrangement, an electrical device (e.g., solenoid), an electric or hydraulic motor arrangement, etc. Moving the seat support 114 toward the cone 120 may increase the contact pressure between the cone 120 and the seat 112 and reduce the stroke of the cone 120 (i.e., the distance the cone 120 travels axially from an open position to a closed position). Moving the seat support 114 away from the cone 120 may decrease the contact pressure between the cone 120 and the seat 112 and increase the stroke of the cone 120. In a similar fashion, the cone 120 may be positioned on a rod (not shown) that can be axially extended/retracted by the actuator 312 to adjust the stroke.

The biasing device 330 may include one or more actuators to control the operating parameters of the biasing force applied to the closure element 320. Illustrative operating parameters include, but are not limited to, magnitude and duration of the biasing force. For example, referring to FIGS. 1A-B, the effective spring force of the spring elements 132 may be adjusted by shifting the position of the piston 138 using an actuator 332.

The dampening device 340 may also include an actuator 342 to control the operating parameters of the dampening force, which controls the force applied to the closure member 320. Illustrative parameters include but are not limited to, the magnitude, duration, and direction of the dampening force. Referring to FIGS. 1A-B, for example, the size of orifices or flow passages in valve elements 212 may be varied to increase or decrease the flow resistance. Also, flow resistance may be varied by changing the viscosity of the fluid surrounding the spring elements 132, such as by using EM-responsive fluids. Further, electrical or electromagnetic devices such as magnet-operated valves controlled by micro-electronic devices or as eddy brakes controlled by appropriately programmed circuitry may be used to generate a dampening force.

Figure 3:
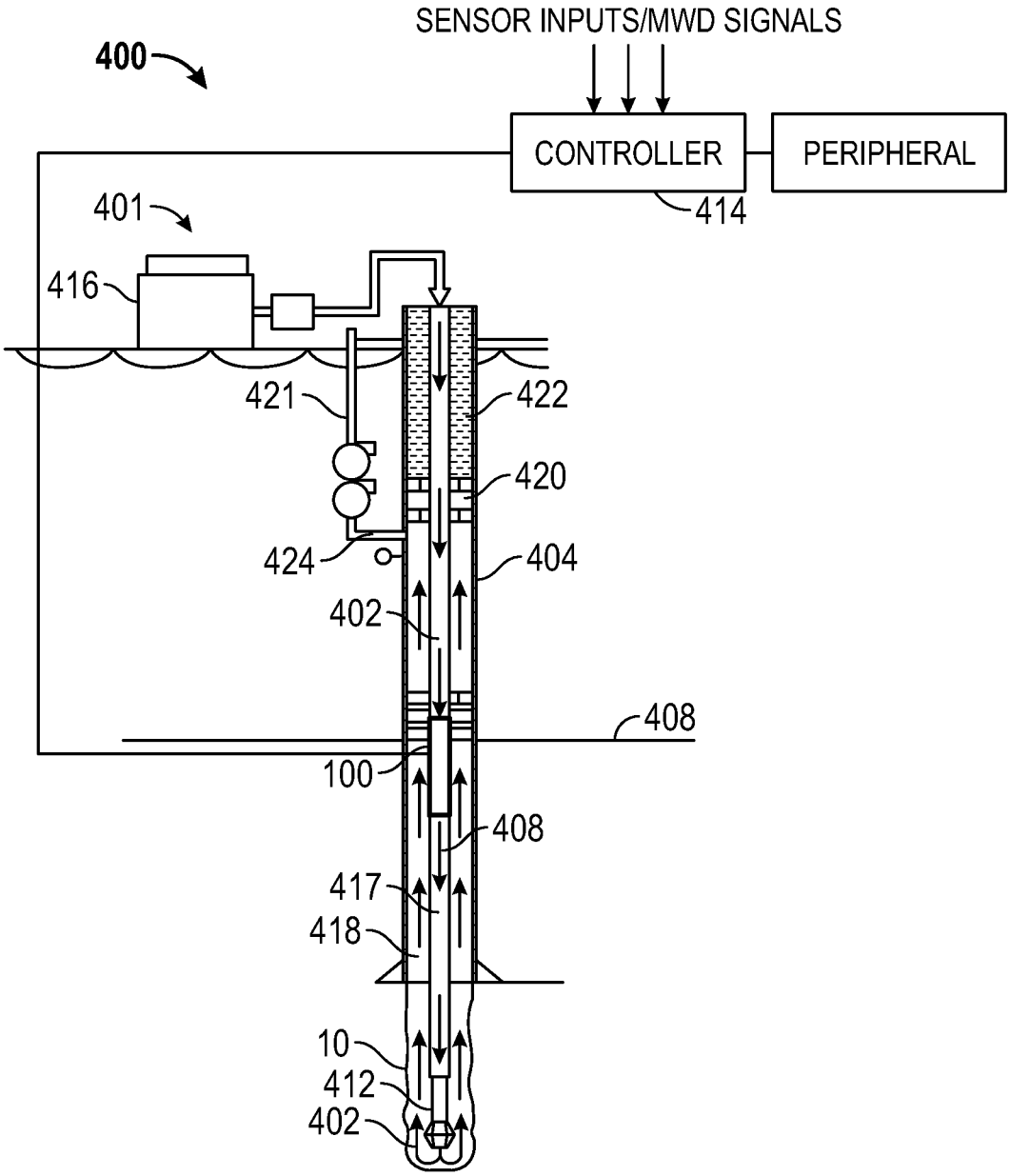
FIG. 3 illustrates a dual gradient drilling system, which may employ flow control devices in accordance with the present disclosure.

The operational behavior of the flow control device 300 may be controlled by a controller 350 that is in communication with actuators 312, 332, and/or 342. The controller 350 may be positioned in the wellbore and/or at a surface location. The controller 350 may include communication links 355 to transmit command signals to the actuators 312, 332, 342 of the flow control device 300. The controller 350 may be in signal communication with one or more sensors 360. The sensors 360 may be positioned in the flow control device 300, along the wellbore 10 (FIG. 3), along a drill string 402 (FIG. 3), and/or at a bottomhole assembly 370, such as a drilling assembly 412 (FIG. 3). Illustrative sensors include, but are not limited to, sensors for measuring or determining position, orientation, pressure, temperature, flow rate, motion (e.g., acceleration), etc. Also, in embodiments, the controller 350 may use a communication link 380 to transmit and receive signals from remote locations such as the surface. The controller may include an information processor that is in data communication with a data storage medium and a processor memory. The data storage medium may store one or more programs that when executed causes the information processor to execute the disclosed method(s).

In one illustrative mode of dynamic control, surface personnel may use the flow control device 100 to vary a flow parameter of a fluid conduit in real time, or near real time. For example, a situation may arise that may require a change in the flow rate or the density of the fluid in the fluid conduit. Such a change may make it desirable to change the operating set points or behavior of the flow control device 100. Thus, surface personnel may transmit downlinks to the controller 350 via the communication link 380 to adjust the magnitude of the biasing force and/or the dampening force to account for the new flow parameter(s). Upon receiving the command signals, the controller 350 issues the appropriate signals to one or more components of the flow control device 350.

In another illustrative mode of dynamic control, the controller 350 may operate in a closed loop fashion by periodically varying the biasing force and/or the dampening force in response to one or more parameters measured by the sensors 360.

It should be appreciated that the teachings of the present disclosure may be used in any number of situations wherein it is desired to form a fluid tight seal along a flow path in a controlled manner. Some of these situations involve an arrangement wherein the fluid flow is used to maintain a flow control device in an open position and the interruption of fluid flow is used to initiate the closing of the fluid flow device. Described below is one non-limiting mode of operation.

Referring now to FIG. 3, there is a system 400 that may use a flow control device 100 for controlling flow during dual gradient drilling. In dual gradient applications, mud pumps on the sea floor may be used to supercharge the drilling fluid so that it returns against a higher geostatic pressure through the annulus/return lines to the surface (drilling platform or ship). This reduces the pressure gradient inside the well annulus, allowing very tight windows between formation fracture pressure and formation pore pressure to be used.

FIG. 3 schematically shows a surface platform 401 from which a drill string 402 may be deployed to drill a wellbore 10. The drill string 402 may be disposed in a conduit formed of a riser 404 that extends from the platform 401 to the seabed 408. The drill string 402 may include a tubular member 408 that carries a bottomhole assembly (BHA) 412 at a distal end. The tubular member, which may be jointed tubulars or coiled tubing, is configured for use in the wellbore 10 (a wellbore tubular) and may include power and/or data conductors such as wires for providing bidirectional communication and power transmission (e.g., wired pipe). The conductors may be optical, metal, etc. Communication signals may also be transmitted by pressure pulses, acoustic signals, EM waves, RF waves, etc. A top drive (not shown), or other suitable rotary power source, may be utilized to rotate the drill string 402. A controller 414 may be placed at the surface for receiving and processing downhole data. The controller 414 may include a processor, a storage device for storing data and computer programs. The processor accesses the data and programs from the storage device and executes the instructions contained in the programs to control the drilling operations.

The system 400 may include a fluid circulation system 416 that flows a drilling fluid into a bore 417 of the drill string 402. The fluid exits and returns to the riser 406 via an annulus 418. The riser 406 may include a restriction device 420 that diverts the fluid flowing in the annulus 418 to a flow cross line or a diverter line 421. A subsea pump 424 pumps the return fluid from the riser 406 to the surface via the diverter line 421. FIG. 3 further illustrates a material 422 having a lower density than the fluid in the annulus 418 in the riser 406 uphole of restriction device 420. The material 422 usually is seawater. However, a suitable fluid could have a density less or greater than seawater. The material 422 is used in providing a static pressure gradient to the wellbore that is less than the pressure gradient formed by the fluid downhole of the flow restriction device 420.

During drilling, fluid circulation system 416 maintains a continuous flow of fluid for the system 400. However, deactivating the fluid circulation system 416 does not immediately stop fluid circulation in the well because the density of the fluid in the bore 417 is greater than the density of the fluid in the annulus 418. That is, fluid in the bore 417 will continue to flow downward and out to the annulus 418 until the hydrostatic pressure in the bore 417 and the annulus 418 are the same. This is sometimes referred to as a "u-tube" effect.

To maintain better control over fluid circulation in the system 400, a flow control device 100 may be positioned along the drill string 402. For example, the enclosure 101 (FIG. 1A, B) may be configured to interconnect with the drill string 402. The operating set points of the fluid circulation system 416 (e.g., flow rate/pressure) may be selected to maintain the flow control device 100 in an open position during normal operation. In the event that fluid circulation is interrupted, the flow control device 100 shifts to the closed position in a manner previously described, which blocks flow down the bore 417 by forming a fluid seal. Even though the hydrostatic pressure in the bore 417 may be greater than the hydrostatic pressure in the annulus 418, the closed fluid control device 100 prevents downward fluid flow.

Also, surface personnel may re-configure the flow control device 100 as needed during drilling to account for dynamic operation conditions. For instance, surface personnel may use the controller 414 to transmit downlinks to the controller 350 (FIG. 2) to adjust the magnitude of the biasing force and/or the dampening force to account for the new flow parameter(s).

The flow control device 100 may also operate in a self-adjusting mode. For example, the controller 350 (FIG. 2) may use data provided by the sensors 360 (FIG. 2) as well as other sensors (not shown) in the wellbore 10 or the riser 404 to periodically varying the biasing force and/or the dampening force.

It should be understood that dual gradient drilling is merely one non-limiting use of flow control devices of the present disclosure. While the foregoing disclosure is directed to the one mode embodiments of the disclosure, various modifications will be apparent to those skilled in the art. It is intended that all variations within the scope of the appended claims be embraced by the foregoing disclosure.

We claim:

1. An apparatus for controlling flow of a fluid from a first section to a second section in a fluid conduit, comprising:

an enclosure enclosing the first section and the second section;

a closure member positioned in the second section;

a biasing member applying a biasing force to the closure member, the biasing member being positioned in the second section;

a mandrel on which the closure member and the biasing member are disposed, the mandrel having a bore and being movably disposed in the enclosure;

a sealing member positioned in the second section and receiving the closure member, a fluid seal being formed in the fluid conduit when the biasing member presses the closure member against the sealing member;

a piston fixed to and moving with the mandrel, wherein a cavity is formed between the piston and the sealing member, and wherein the cavity receives the fluid from the first section when the closure member unseats from the sealing member;

a flow path conveying the fluid from the first section to the second section, the flow path including the bore of the mandrel, wherein the fluid seal blocks fluid flowing along the flow path from the first section to the bore of the mandrel; and a dampener positioned in the second section and operatively connected to the closure member, the dampener resisting a force applied to the closure member, wherein the dampener includes a first chamber, and wherein movement of the mandrel and the piston in response to pressure in the cavity reduces a volume of the first chamber.

2. The apparatus of claim 1, wherein the dampener includes a fluid body responsive to the movement of the closure member.

3. The apparatus of claim 2, wherein the dampener further includes a second chamber, the fluid body flowing between the first chamber and the second chamber in response to movement of the closure member.

4. The apparatus of claim 3, wherein the dampener further includes at least one flow control member controlling flow between the first and the second chamber.

5. The apparatus of claim 4, further comprising an actuator configured to control the force applied to the closure member.

6. The apparatus of claim 5, wherein the actuator is configured to adjust one of: (i) the biasing force, and (ii) the dampening force.

7. The apparatus of claim 5, further comprising a controller operatively coupled to the actuator, the controller being responsive to: (i) a signal generated at a surface location, and (ii) a signal generated at a downhole location, (iii) a signal generated by a sensor.

8. The apparatus of claim 1, wherein the dampener includes one of: (i) a friction element, (ii) a magnetic element, (iii) an electro-magnetic element, and (iv) a magnetorheological fluid.

9. The apparatus of claim 1, further comprising a wellbore tubular in which the fluid conduit is formed, the closure member and sealing member cooperating to control fluid flow along the fluid conduit.

10. The apparatus of claim 9, further comprising a fluid circulation device configured to convey a drilling fluid through the fluid conduit; and an annular flow space surrounding the fluid conduit, the annular flow space directing the drilling fluid to a surface location.

11. The apparatus of claim 10, wherein:

the closure member and sealing member cooperate to form a seal when the fluid circulation device is deactivated;

the dampener is configured to resist the biasing force applied by the biasing member to the closure device after the fluid circulation device is deactivated; and the dampener is further configured to resist a pressure applied to the closure member by a fluid in the flow conduit.

12. A method for controlling flow of a fluid from a first section to a second section, comprising:

enclosing the first section and the second section in an enclosure;

forming a flow path conveying the fluid from the first section to the second section;

movably disposing a mandrel in the enclosure;

disposing a closure member and a biasing member on the mandrel, the mandrel having a bore, the flow path including the bore of the mandrel;

positioning a sealing member, the biasing member, and the closure member in the second section and along a flow path of the flowing fluid;

forming a fluid seal in the fluid conduit when the biasing member presses the closure member against the sealing member, wherein the fluid seal blocks fluid flowing along the flow path from the first section to the bore of the mandrel;

fixing a piston to the mandrel such that the piston moves with the mandrel, wherein a cavity is formed between the piston and the sealing member, and wherein the cavity receives the fluid from the first section when the closure member unseats from the sealing member;

applying a compressive force on the sealing member using a biasing member; and resisting a force applied to the closure member using a dampener positioned in the second section, and connected to the closure member wherein the dampener includes a first chamber, and wherein movement of the mandrel and the piston in response to pressure in the cavity reduces a volume of the first chamber.

13. The system of claim 12, further comprising controlling the force applied to the closure member using an actuator.

14. The method of claim 12, further comprising flowing the fluid in a wellbore tubular, and controlling the fluid flow in the wellbore tubular using the closure member and sealing member.

15. The method of claim 14, further comprising conveying a drilling fluid through the wellbore tubular using a fluid circulation device.

16. The method of claim 15, further comprising:

forming a seal when the fluid circulation device is deactivated using the closure member and sealing member;

resisting the compressive force applied by the biasing member to the closure device after the fluid circulation device is deactivated using the dampener; and resisting a pressure applied to the closure member by a fluid in the flow conduit using the dampener.

17. A system for controlling flow of fluid, comprising:

a platform;

a drill string conveyed into a wellbore form the platform;

a fluid circulation system configured to flow a drilling fluid into the drill string, wherein the drilling fluid returns from the wellbore via an annulis of the wellbore;

a flow control device positioned along the wellbore for controlling the flow of the drilling fluid, the flow control device including:

an enclosure enclosing the first section and the second section;

a closure member positioned in the second section;

a biasing member applying a biasing force to the closure member, the biasing member being positioned in the second section;

a mandrel on which the closure member and biasing member are disposed, the mandrel having a bore and being movably disposed in the enclosure;

a sealing member positioned in the second section and receiving the closure member, a fluid seal being formed in the fluid conduit when the biasing member presses the closure member against the sealing member;

a piston fixed to and moving with the mandrel, wherein a cavity is formed between the piston and the sealing member, and wherein the cavity receives the fluid from the first section when the closure member unseats from the sealing member;

a flow path conveying the fluid from the first section to the second section, the flow path including the bore of the mandrel, wherein the fluid seal blocks fluid flowing along the flow path from the first section to the bore of the mandrel; and a dampener positioned in the second section and operatively connected to the closure member, the dampener resisting a force applied to the closure member, wherein the dampener includes a first chamber, and wherein movement of the mandrel and the piston in response to pressure in the cavity reduces a volume of the first chamber.

18. The system of claim 17, wherein the dampener includes a fluid body responsive to the movement of the closure member.

19. The system of claim 18, wherein the dampener further includes a second chamber, the fluid body flowing between the first chamber and second chamber in response to movement of the closure member.

* * * * *